US008896410B2

(12) United States Patent
Saito et al.

(10) Patent No.: US 8,896,410 B2
(45) Date of Patent: Nov. 25, 2014

(54) CHIP THERMISTOR AND METHOD OF MANUFACTURING SAME

(75) Inventors: Yo Saito, Tokyo (JP); Kouki Yamada, Tokyo (JP); Daisuke Tsuchida, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/805,043

(22) PCT Filed: Jun. 21, 2011

(86) PCT No.: PCT/JP2011/064171

§ 371 (c)(1),
(2), (4) Date: Dec. 18, 2012

(87) PCT Pub. No.: WO2011/162260

PCT Pub. Date: Dec. 29, 2011

(65) Prior Publication Data

US 2013/0088319 A1 Apr. 11, 2013

(30) Foreign Application Priority Data

Jun. 24, 2010 (JP) ..... 2010-144015

(51) Int. Cl.

| | |
|---|---|
| ***H01C 7/02*** | (2006.01) |
| ***H01C 7/04*** | (2006.01) |
| ***H01C 17/00*** | (2006.01) |
| ***H01C 7/00*** | (2006.01) |
| ***H01C 1/14*** | (2006.01) |

(52) U.S. Cl.

CPC ..... *H01C 7/04* (2013.01); *H01C 17/00* (2013.01); *H01C 7/008* (2013.01); *H01C 1/1413* (2013.01)

USPC ..... 338/25; 338/22 R

(58) Field of Classification Search

CPC .... H01C 7/008; H01C 7/18; H01C 17/06533; H01C 7/10; H01C 7/043; H01C 1/148; H01C 7/025; H01C 7/13; H01C 7/02; H01C 7/041; H01C 1/14; H01C 1/1413; H01C 7/04; H01C 17/00; H01C 7/021; H01C 1/00

USPC ..... 338/22 R, 25

See application file for complete search history.

(56) References Cited

U.S. PATENT DOCUMENTS 5,790,011 A * 8/1998 Hirano et al. ..... 338/22 R
5,907,271 A * 5/1999 Hirano et al. ..... 338/22 R (Continued)

FOREIGN PATENT DOCUMENTS

JP A-4-247603 9/1992
JP A-5-335113 12/1993

(Continued)

OTHER PUBLICATIONS

International Search Report issued in International Patent Application PCT/JP2011/064171 dated Sep. 20, 2011.

(Continued)

*Primary Examiner* — Kyung Lee
(74) *Attorney, Agent, or Firm* — Oliff PLC

(57) ABSTRACT

A chip thermistor has a thermistor portion including a ceramic material containing respective metal oxides of Mn, Ni, and Co as major ingredients; a pair of composite portions including a composite material of Ag—Pd, and respective metal oxides of Mn, Ni, and Co and arranged on both sides of the thermistor portion so as to sandwich in the thermistor portion between the composite portions; and external electrodes connected to the pair of composite portions, respectively. In this manner, the pair of composite portions are used as bulk electrodes and, for this reason, the resistance of the chip thermistor can be adjusted mainly with consideration to the resistance in the thermistor portion without need for much consideration to the distance between the external electrodes and other factors.

19 Claims, 10 Drawing Sheets

(56) References Cited

U.S. PATENT DOCUMENTS

| | | | | |
|---|---|---|---|---|
| 6,081,181 | A | 6/2000 | Kawase et al. | |
| 6,133,821 | A * | 10/2000 | Nabika et al. | 338/22 R |
| 6,515,572 | B2 * | 2/2003 | Groen et al. | 338/22 R |
| 8,508,325 | B2 * | 8/2013 | Ueda et al. | 338/20 |
| 2010/0117782 | A1 | 5/2010 | Sato et al. | |

FOREIGN PATENT DOCUMENTS

| | | |
|---|---|---|
| JP | A-6-151110 | 5/1994 |
| JP | A-06-168803 | 6/1994 |
| JP | A-07-099101 | 4/1995 |
| JP | A-10-116704 | 5/1998 |
| JP | A-10-144561 | 5/1998 |
| JP | A-2009-59755 | 3/2009 |
| JP | A-2009-277801 | 11/2009 |
| JP | A-2011-003612 | 1/2011 |

OTHER PUBLICATIONS

International Preliminary Report on Patentability issued in International Patent Application No. PCT/JP2011/064171 dated Jan. 15, 2013.

* cited by examiner

CHIP THERMISTOR AND METHOD OF MANUFACTURING SAME

TECHNICAL FIELD

The present invention relates to a chip thermistor and a method for manufacturing it.

BACKGROUND ART

There is a conventionally known chip thermistor in which external electrodes are formed at both ends of a thermistor element body containing, for example, metal oxides of Mn, Co, and Ni as major ingredients (see, for example Patent Literature 1). In the chip thermistor of this kind, the overall resistance of the chip thermistor is determined by the specific resistance of the thermistor element body and the distance between the external electrodes formed at the both ends thereof.

CITATION LIST

Patent Literature

Patent Literature 1: Japanese Patent Application Laid-Open No. H10-116704

Patent Literature 2: Japanese Patent Application Laid-Open No. 2009-59755

SUMMARY OF INVENTION

Technical Problem

Incidentally, in the chip thermistor of this configuration, the overall resistance of the chip thermistor varies depending upon a plurality of factors such as the specific resistance of the thermistor element body, the distance between the external electrodes, and the shape thereof, and, therefore, consideration must be given to the plurality of factors, for achieving a desired value of resistance of the chip thermistor; it was thus sometimes difficult to adjust the resistance of the chip thermistor to a desired value. Particularly, in the case where the chip thermistor had an extremely small size like the 0402 type (0.4 mm long×0.2 mm high×0.2 mm wide), there was the problem that it became difficult to control the distance between the external electrodes or the like to a desired value and it was further difficult to adjust the resistance of the chip thermistor to a desired value.

It is an object of the present invention to provide a chip thermistor allowing easy adjustment of resistance and a method for manufacturing it.

Solution to Problem

To resolve the above problem, a chip thermistor according to the present invention comprises: a thermistor portion comprised of a ceramic material containing a metal oxide as a major ingredient; a pair of composite portions comprised of a composite material including a metal and a metal oxide and arranged on both sides of the thermistor portion so as to sandwich in the thermistor portion between the composite portions; and external electrodes arranged at both ends in a longitudinal direction of an substantially rectangular parallelepiped shaped element body which includes the thermistor portion and the pair of composite portions, the external electrodes are connected to the pair of composite portions respectively.

The chip thermistor according to the present invention is configured that the pair of composite portions are arranged on both sides of the thermistor portion so as to sandwich in the thermistor portion between them and that the external electrodes are connected to the pair of composite portions. For this reason, the resistance of the chip thermistor can be adjusted mainly with consideration to the resistance in the thermistor portion, without need for much consideration to, for example, the distance between the external electrodes, the shape thereof, and so on. Therefore, this chip thermistor allows easy adjustment of the resistance. The chip thermistor is configured that the composite portions sandwich in the thermistor portion between them in the longitudinal direction of the substantially rectangular parallelepiped shaped element body. For this reason, a design range of the thickness of the thermistor portion is relatively widened, thereby the chip thermistor allows easy adjustment of the resistance in this point.

The chip thermistor according to the present invention is configured that the pair of composite portions sandwich in the thermistor portion between them and that the external electrodes are connected to the pair of composite portions (e.g., cf. FIG. 2). For this reason, the chip thermistor of the present invention can also have the resistance lower than that of the conventional configuration in which the external electrodes are connected directly to the thermistor element body (cf. FIG. 2 in Patent Literature 1 etc.), when they have the same chip size. Since the resistance can be varied by adjusting the thickness of the thermistor portion or the like, it is feasible to widen the range of adjustment of resistance.

In the chip thermistor according to the present invention, the composite portions are arranged between the thermistor portion and the external electrodes and the composite portions are comprised of the composite material of the metal and the metal oxide. For this reason, heat in the chip thermistor can be readily dissipated through the composite portions, whereby the chip thermistor can be obtained with excellent heat dissipation. Particularly, the thermistor originally has a property of varying its resistance with heat, and thus the excellent heat dissipation leads to improvement in thermal responsiveness, so as to allow more accurate detection. Since the chip thermistor has the excellent heat dissipation, it is also feasible to increase the rated power of the chip thermistor and thus to apply the chip thermistor to usage in various fields.

In the chip thermistor according to the present invention, each of the external electrodes may be configured to cover respective end faces in the longitudinal direction of the element body. In this case, connection strength between the external electrodes and the composite portions which constitute a part of the element body is made firm.

In the chip thermistor according to the present invention, each of the external electrodes may be configured to oppose to each other on at least one side face which extends along the longitudinal direction of the element body. In this case, connection strength between the external electrodes and the composite portions which constitute a part of the element body is made further firm. Since the external electrodes are formed on the side face of the element body, it is feasible to easily mount the chip thermistor on a surface of a substrate or the like In the chip thermistor according to the present invention, the thermistor portion may be configured in a layered structure such that a direction in which the pair of composite portions are opposed to each other is a laminated direction. In this case, the thickness of the thermistor portion (thickness in the direction in which the composite portions are opposed to each other) can be adjusted by the number of laminated thermistor layers. This allows easy adjustment of the resistance of the chip thermistor which bears a proportional relation to the thickness of the thermistor portion. Since the resistance of the chip thermistor is adjusted by the number of laminated thermistor layers, it is feasible to readily suppress variation in resistance in each chip thermistor and, particularly, in the case of the chip thermistor of an extremely small size, the variation can be drastically suppressed. Namely, this configuration allows the chip thermistor to be readily obtained in an extremely small size and with high detection accuracy.

In the chip thermistor according to the present invention, each of the pair of composite portions may be configured in a layered structure such that a direction in which the pair of composite portions are opposed to each other is a laminated direction. In this case, the length of each composite portion (length in the direction in which the composite portions are opposed to each other) can be readily adjusted by the number of laminated composite layers. If both of the thermistor portion and the composite portions are configured in the layered structure, the overall length of the chip thermistor or the like can be readily adjusted and, even in the case of the chip thermistor of an extremely small size, the chip thermistor can be readily obtained with high dimensional accuracy.

In the chip thermistor according to the present invention, the thermistor portion may be substantially totally connected to the pair of composite portions, on both sides thereof. In this case, secure coupling is made between the thermistor portion and the composite portions.

In the chip thermistor according to the present invention, the thermistor portion may be composed of a thermistor element having a negative characteristic, and a thickness of the thermistor portion in the direction in which the pair of composite portions are opposed to each other may be any length in the range of 0.01 times to 0.8 times a longitudinal length of the element body. In this case, the resistance of the chip thermistor as an NTC (Negative Temperature Coefficient) thermistor can be set rather smaller. Particularly, in terms of reduction in resistance, the thickness of the thermistor portion is preferably not more than 0.1 times the longitudinal length of the element body.

In the chip thermistor according to the present invention, the composite material may be a material in which the metal is dispersed in the metal oxide or in which the metal oxide is dispersed in the metal. Furthermore, in each of the pair of composite portions, the metal in the composite material may form an electrical conduction path between the external electrode and the thermistor portion.

In the chip thermistor according to the present invention, an insulating layer may be formed at least over a region across the thermistor portion out of an exterior surface of the element body. In this case, it is feasible to more eliminate the influence of the distance between the external electrodes and other factors on the resistance of the chip thermistor. When the insulating layer is formed on the exterior surface of the element body, the external electrodes may be formed by electroplating.

In the chip thermistor according to the present invention, the external electrodes may be formed by directly plating the composite portions which constitutes a part of the element body. In the case, processes such as printing and burning one electrode layer that forms part of the external electrodes become unnecessary, and the thermal influence of burning on the chip thermistor can be reduced. Furthermore, since one electrode layer that forms part of the external electrodes is no longer required, a further reduction in the size of the chip thermistor becomes possible. Also, the plating is coated along the shape of the element, and thus the flatness of the exterior of the chip thermistor can be enhanced, thereby preventing the chip thermistor from tumbling in a housing for a series of electronic components, and making it possible to reduce faults in installing the chip thermistor onto a substrate or the like.

In the chip thermistor according to the present invention, the external electrodes are configured to cover substantially all of outer surfaces of the composite portions which constitute a part of the element body. In this case, since the thicknesses of the composite portions directly correspond to the widths of the external electrodes, variations of the width measurements in both external electrodes can be suppressed. As a result of this, it is possible to reduce phenomena such as tombstoning upon installation, which is caused by differences in the melting time of solder due to variations in the width measurements of the external electrodes.

In the chip thermistor according to the present invention, the external electrodes are configured not to cover the thermistor portion which constitutes a part of the element body. In the case, it is feasible to reduce the influence to the resistance if the thickness of the thermistor portion is thin.

To resolve the above problem, a method for manufacturing a chip thermistor according to the present invention, comprises preparing thermistor layers comprised of a ceramic material containing a metal oxide as a major ingredient, preparing composite layers comprised of a composite material including a metal and a metal oxide, laminating the thermistor layers and the composite layers to obtain a multilayer body such that a predetermined number of thermistor layers are sandwiched in between the composite layers, cutting the multilayer body to obtain a plurality of element bodies, and forming external electrodes at both ends of the element bodies in such a manner that a laminated direction of the thermistor layers and the composite layers is a direction in which the external electrodes are opposed to each other.

In the manufacturing method of the chip thermistor according to the present invention, the chip thermistor is manufactured by preparing the thermistor layers comprised of the ceramic material containing the metal oxide as a major ingredient and the composite layers comprised of the composite material including the metal and the metal oxide, laminating the thermistor layers and the composite layers so as to sandwich in the predetermined number of thermistor layers between the composite layers, and so on. In this case, the resistance of the chip thermistor manufactured can be adjusted mainly with consideration to the number of laminated thermistor layers, without need for much consideration to, for example, the distance between the external electrodes and other factors. Therefore, this manufacturing method of the chip thermistor allows the chip thermistor to be manufactured with easy adjustment of the resistance of the chip thermistor.

Since the manufacturing method of the chip thermistor according to the present invention allows the adjustment of the resistance of the chip thermistor by the number of laminated thermistor layers, the chip thermistor can be manufactured with suppression of variation in resistance, and, particularly, in the case of the chip thermistor of an extremely small size, it can be manufactured with suppression of variation. Since the chip thermistor is manufactured by laminating the thermistor layers and the composite layers, the overall length of the chip thermistor or the like can also be readily adjusted and, even in manufacturing the chip thermistor in an extremely small size, the chip thermistor can be readily manufactured with high dimensional accuracy.

Advantageous Effects of Invention

According to the present invention, it is feasible to provide the chip thermistor allowing easy adjustment of the resistance and the method for manufacturing it.

DESCRIPTION OF EMBODIMENTS

Embodiments of the present invention will be described below in detail with reference to the accompanying drawings. In the description, the same elements or elements with the same functionality will be denoted by the same reference signs, without redundant description.

First Embodiment

Figure 1:
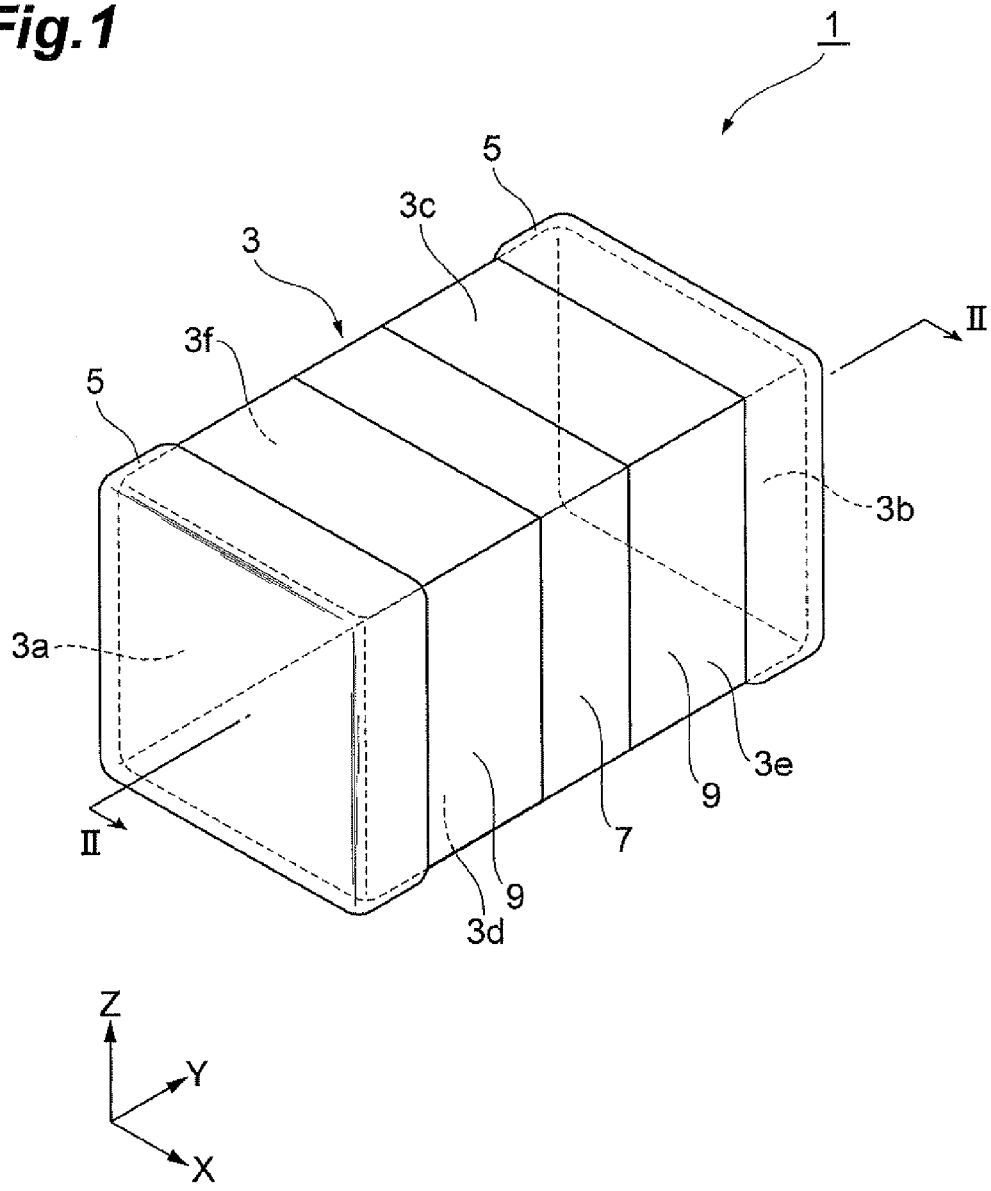
FIG. 1 is a perspective view showing a chip thermistor according to a first embodiment.

A chip thermistor 1 is an NTC thermistor and, as shown in FIG. 1, comprises an element body 3 of a substantially rectangular parallelepiped shape, and a pair of external electrodes 5, 5 formed at both ends in a longitudinal direction of the element body 3. This chip thermistor 1 is, for example, a thermistor of an extremely small size having the length of 0.4 mm in the Y-direction in the drawing, the height of 0.2 mm in the Z-direction, and the width of 0.2 mm in the X-direction (which is so called "0402").

The element body 3 is configured to include a thermistor portion 7 and a pair of composite portions 9. The element body 3 has square end faces 3*a*, 3*b* opposed to each other, and four side faces 3*c* to 3*f* perpendicular to the end faces 3*a*, 3*b* as outer surfaces. The four side faces 3*c* to 3*f* extend so as to interconnect the end faces 3*a*, 3*b*. The end faces 3*a*, 3*b* may form rectangular shape.

Figure 2:
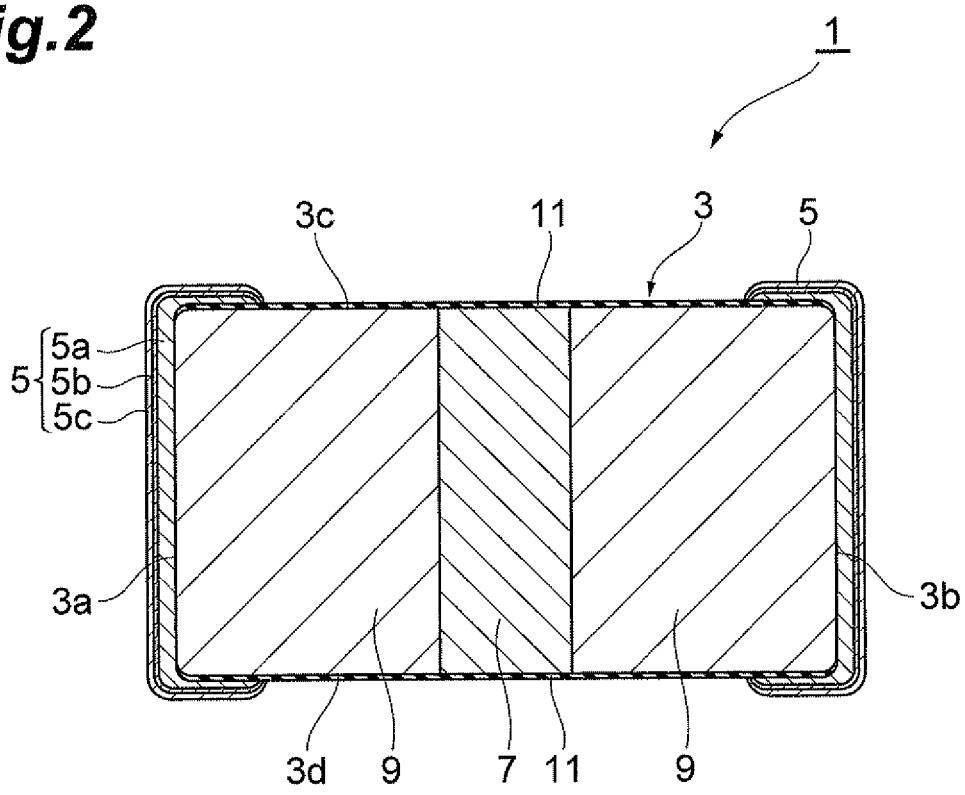
FIG. 2 is a cross-sectional view along the line II-II in FIG. 1.
Figure 3:
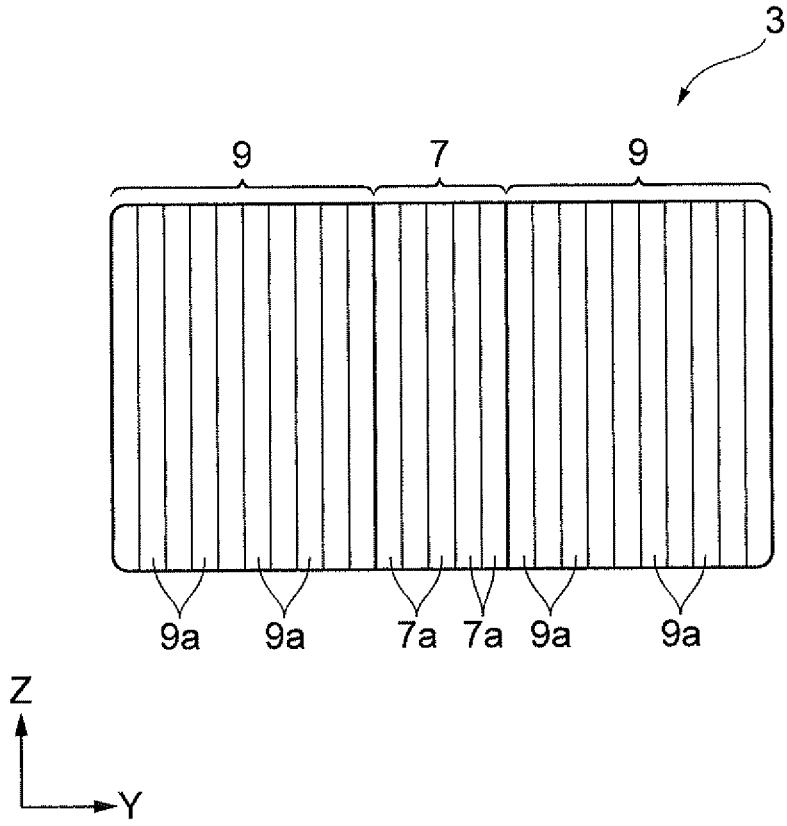
FIG. 3 is a schematic cross-sectional view showing a laminated state of a thermistor portion and composite portions.

The thermistor portion 7, as shown in FIGS. 1 and 2, is a portion of a rectangular parallelepiped shape located in a nearly central region of the element body 3 and is composed of a thermistor element having a negative characteristic. The thermistor portion 7, as shown in FIG. 3, is formed as a portion in a layered structure in which a plurality of thermistor layers 7*a* with a predetermined B value are laminated in the Y-direction in the drawing (in a direction in which the composite portions 9 are opposed to each other). In the present embodiment, the plurality of thermistor layers 7*a* are laminated so that the thickness of the thermistor portion 7 is, for example, 100 μm; therefore, the thickness of the thermistor portion 7 is 0.25 times (or 25% of) 400 μm being the longitudinal (Y-directional) length of the element body 3.

The thermistor layers 7*a* constituting the thermistor portion 7 are made, for example, of a ceramic material containing respective metal oxides of Mn, Ni, and Co as major ingredients. The thermistor layers 7*a* may contain minor ingredients of Fe, Cu, Al, Zr, etc. to adjust characteristics, in addition to the respective metal oxides of Mn, Ni, and Co as major ingredients. The thermistor portion 7 may be made of respective metal oxides of Mn and Ni or respective metal oxides of Mn and Co, instead of the respective metal oxides of Mn, Ni, and Co.

The composite portions 9, as shown in FIGS. 1 and 2, are portions of a substantially rectangular parallelepiped shape located in regions shifted from the central region of the element body 3 to the both end sides, and are arranged on both sides of the thermistor portion 7 so as to sandwich in the thermistor potion 7 between them. The composite portions 9, as shown in FIG. 3, are formed as portions in a layered structure in which a plurality of composite layers 9*a* comprised of a composite material including Ag—Pd (metal) and respective metal oxides of Mn, Ni, and Co, are laminated in the Y-direction in the drawing. Since each of the composite portions 9 opposed to each other with the thermistor portion 7 in between is formed of a laminate of the same number of composite layers 9*a*, they have the same size. The thermistor portion 7 made of the material containing the metal oxides similar to those making up the composite portions 9 is substantially totally connected to each of the composite portions 9, on both sides thereof, and they both are formed so as to contain the metal oxides of the same kinds; therefore, the connection strength is high at interfaces between the thermistor portion 7 and the composite portions 9.

Figure 4:
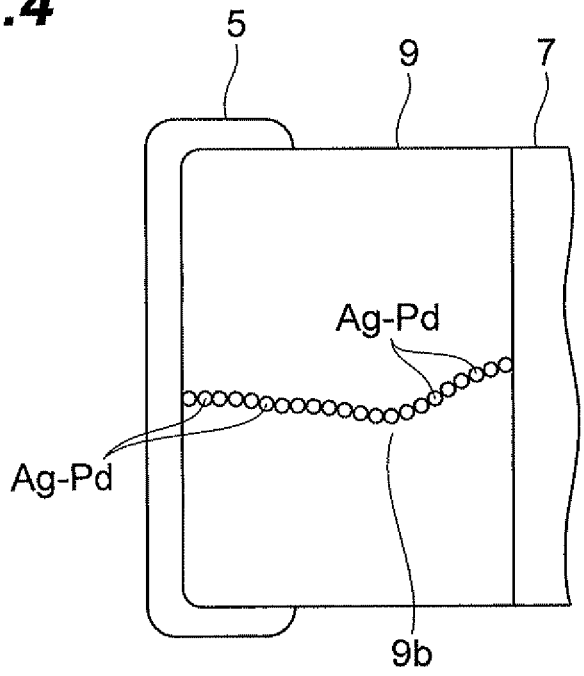
FIG. 4 is a schematic cross-sectional view showing an electrical conduction path in a composite portion.

In the composite material making up the composite portions 9, Ag—Pd is in a state in which Ag—Pd is dispersed in the aforementioned metal oxides and, as shown in FIG. 4, Ag—Pd forms an electrical conduction path 9*b* connecting the external electrode 5 and the thermistor portion 7. FIG. 4 shows only one electrical conduction path 9*b*, for easier understanding of description, but it is the case that there are a number of electrical conduction paths 9*b* created in each composite portion 9. The composite portions 9 may contain any one of Ag, Au, Pd, Pt, etc. as the metal contained therein, instead of Ag—Pd. The composite portions 9 may contain respective metal oxides of Mn and Ni or respective metal oxides of Mn and Co as the metal oxides, instead of the respective metal oxides of Mn, Ni, and Co.

As shown in FIG. 2, an insulating layer 11 is formed on the side faces 3*c* to 3*f* of the element body 3 (which is omitted in the other drawings). The insulating layer 11 is comprised of, for example, $SiO_2$, $ZrO_2$, $Al_2O_3$, or the like. The insulating layer 11 is formed so as to cover at least an exposed surface of the thermistor portion 7, which prevents the external electrodes 5 and the thermistor portion 7 from being directly connected. The insulating layer 11 may not form in the chip thermistor 1.

The pair of external electrodes 5, 5 are formed in a multilayer structure so as to cover the respective end faces 3*a*, 3*b* of the element body 3. The external electrode 5 includes: a first electrode layer 5*a* directly connected to the composite portion 9 of the element body 3 and containing an electroconductive powder containing Ag or the like as a major ingredient, and a glass frit; a second electrode layer 5*b* formed so as to cover the first electrode layer 5*a* and containing Ni as a major ingredient; and a third electrode layer 5*c* formed so as to cover the second electrode layer 5*b* and containing Sn as a major ingredient.

Figure 5:
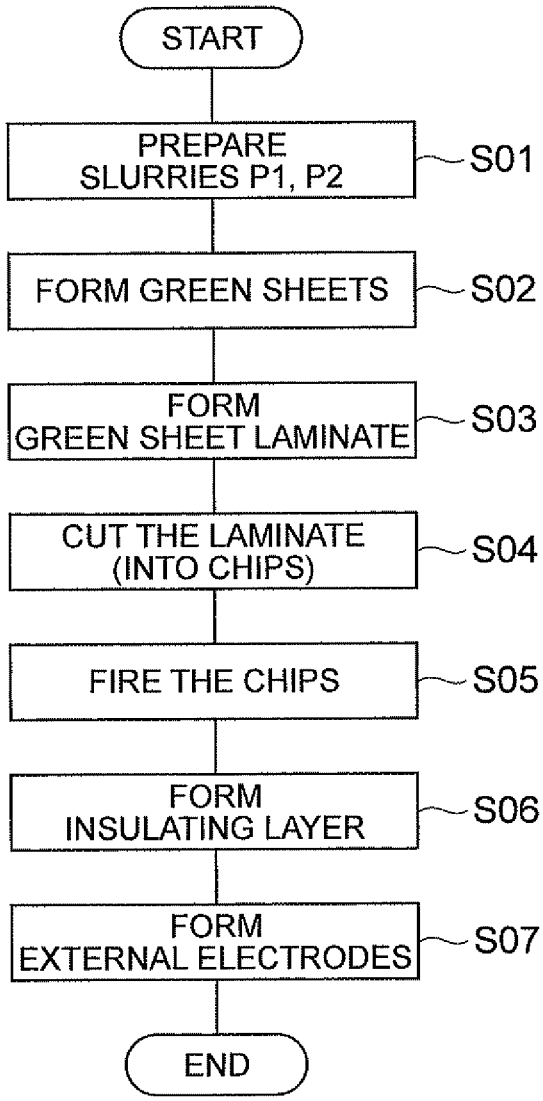
FIG. 5 is a flowchart showing steps of manufacturing the chip thermistor shown in FIG. 1.

Next, a method for manufacturing the chip thermistor 1 will be described with reference to FIG. 5.

First, a well-known method is employed to prepare a thermistor material by mixing respective metal oxides of Mn, Ni, and Co as major ingredients of the thermistor layers 7*a*, and Fe, Cu, Al, Zr, etc. as minor ingredients at a predetermined ratio. Then an organic binder and other matter are added in this thermistor material to obtain a slurry P1 (step S01). Similarly, a composite material is prepared by mixing Ag—Pd and respective metal oxides of Mn, Ni, and Co to be contained in the composite material making up the composite layers 9*a*, at a predetermined ratio. Then an organic binder and other matter are added in this composite material to obtain a slurry P2 (step S01).

Figure 6:
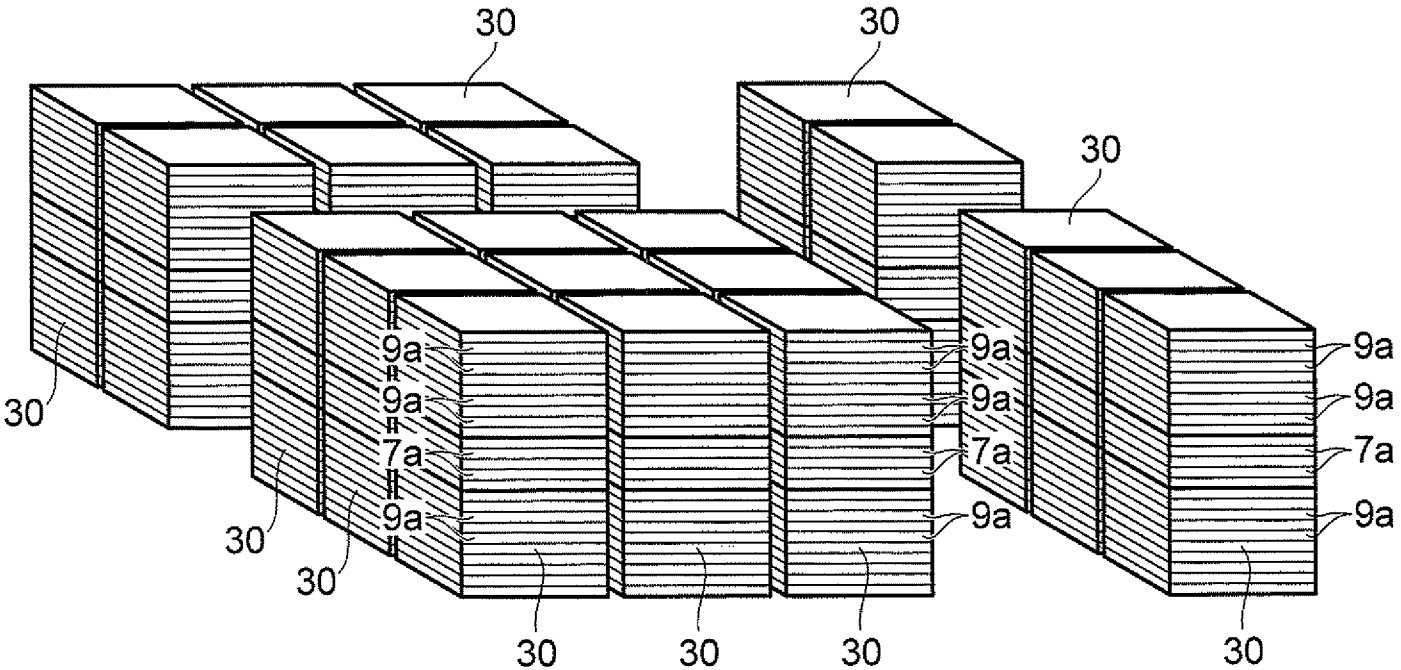
FIG. 6 is a perspective view showing a state in which a multilayer body is cut, in a step of manufacturing the chip thermistor.

Next, each of the slurries P1, P2 prepared is applied onto film to form green sheets corresponding to the thermistor layers 7*a* or green sheets corresponding to the composite layers 9*a*, respectively (step S02). Thereafter, the respective green sheets corresponding to the thermistor layers 7*a* and the composite layers 9*a* are laminated in such a manner that a predetermined number of green sheets corresponding to the thermistor layers 7*a* are sandwiched in between the green sheets corresponding to the composite layers 9*a* (cf. FIG. 6). Thereafter, the laminated green sheets are kept under pressure to be compressively bonded to each other, thereby forming a green sheet laminate (step S03). This green sheet laminate is dried and then, as shown in FIG. 6, it is cut into chip units with a dicing saw or the like to obtain a plurality of green bodies 30 (element bodies 3 before fired) (step S04).

After that, the plurality of green bodies 30 are thermally treated at the temperature of 180° C. to 400° C. for about 0.5 to 24 hours to be subjected to debindering. After the debindering process, the green bodies 30 are heated at the temperature of not less than 800° C. in an air or oxygen ambience to fire the thermistor portion 7 and the composite portions 9 together (step S06). This step results in forming the element bodies 3. It is optional to perform barrel polishing on an as-needed basis, after the firing. Then the insulating layer 11 consisting of $SiO_2$ or the like is formed on the outer surface of each element body by sputtering or the like so as to cover the side faces 3*c* to 3*f* of the element body (step S06).

The next step is to prepare an electroconductive paste by mixing an organic binder and an organic solvent into a metal powder containing Ag, Cu, or Ni as a major ingredient, and a glass frit. Then this electroconductive paste is applied by a transfer method so as to cover the both end faces 3*a*, 3*b* of each element body 3 and is then baked to form the first electrode layer 5*a*. Subsequently, electroplating processes such as Ni plating and Sn plating are carried out so as to cover the first electrode layer 5*a*, thereby forming the second and third electrode layers 5*b*, 5*c*. This forms the external electrodes 5 at both ends of the element body 3 so that the laminated direction of the thermistor layers 7*a* and the composite layers 9*a* is a direction in which the external electrodes 5 are opposed to each other (step S07), thereby completing the chip thermistor 1.

As described above, the chip thermistor 1 of the present embodiment is configured, as shown in FIG. 2, so that the pair of composite portions 9, 9 are arranged on both sides of the thermistor portion 7 so as to sandwich in the thermistor portion 7 between them and the external electrodes 5, 5 are connected to the pair of composite portions 9, 9. Namely, the pair of composite portions 9, 9 are used as bulk electrodes. For this reason, the resistance of the chip thermistor 1 can be adjusted mainly with consideration to the resistance in the thermistor portion 7, without need for much consideration to, for example, the distance between the external electrodes 5, 5, the shape thereof, and so on. Therefore, this chip thermistor 1 allows easy adjustment of the resistance.

The chip thermistor 1, having the above-described configuration, can also have the resistance lower than that of the conventional configuration wherein the external electrodes are connected directly to the thermistor element body (cf. FIG. 2 in Patent Literature 1), when they have the same chip size. Since the resistance can be varied by adjusting the thickness of the thermistor portion 7 or the like, the range of adjustment of resistance can also be expanded.

In the chip thermistor 1, the composite portions 9, 9 are arranged between the thermistor portion 7 and the external electrodes 5, 5 and the composite portions 9, 9 are made of the composite material of the metal and metal oxides. For this reason, heat in the chip thermistor 1 can be readily dissipated through the composite portions 9, 9, whereby the chip thermistor 1 can be obtained with excellent heat dissipation. Particularly, the thermistor originally has a property of varying its resistance with heat, and thus the excellent heat dissipation leads to improvement in thermal responsiveness, so as to make the chip thermistor 1 capable of more accurate detection. Since the chip thermistor 1 is provided with the excellent heat dissipation, the rated power of the chip thermistor can also be increased, allowing the chip thermistor to be applied to usage in various fields.

In the chip thermistor 1, the thermistor portion 7 is formed in the layered structure such that the direction in which the pair of composite portions 9, 9 are opposed to each other is the laminated direction. For this reason, the thickness of the thermistor portion 7 (thickness in the direction in which the composite portions 9, 9 are opposed to each other) can be adjusted by the number of laminated thermistor layers 7*a*, which allows easy adjustment of the resistance of the chip thermistor 1 bearing a proportional relation to the thickness of the thermistor portion 7. Since the resistance of the chip thermistor 1 is adjusted by the number of laminated thermistor layers 7*a*, it is easy to suppress variation in resistance of the chip thermistor 1 and, particularly, in the case of the chip thermistor 1 of an extremely small size, the variation can be significantly suppressed. In other words, the configuration in the present embodiment allows the chip thermistor 1 to be readily obtained in an extremely small size and with high detection accuracy.

In the chip thermistor 1, each of the pair of composite portions 9, 9 is formed in the layered structure such that the direction in which the pair of composite portions 9, 9 are opposed to each other is the laminated direction. For this reason, the length of each composite portion 9, 9 (length in the direction in which the composite portions 9, 9 are opposed to each other) can be readily adjusted by the number of laminated composite layers. Particularly, since both of the thermistor portion 7 and the composite portions 9, 9 are formed in the layered structure in the chip thermistor 1, it is easy to adjust the overall length of the chip thermistor 1 and even if the chip thermistor has an extremely small size (0402 type) like the chip thermistor 1, the chip thermistor can be readily obtained with high dimensional accuracy.

In the chip thermistor 1, the thermistor portion 7 is substantially totally connected to the pair of composite portions 9, 9, on both sides thereof. Since they are connected across the wide region, secure coupling is achieved between the thermistor portion 7 and the composite portions 9, 9. In addition, since the thermistor portion 7 and the composite portions 9 are configured to contain the metal oxides of the same kinds in the present embodiment, the coupling between them can be made firmer.

In the chip thermistor 1, the element body 3 of the substantially rectangular parallelepiped shape is formed of the thermistor portion 7 and the pair of composite portions 9, 9 and the insulating layer 11 is formed on the side faces 3*c* to 3*f* of the element body 3 including the region across the thermistor portion 7. This insulating layer 11 prevents the external electrodes 5 from being connected directly to the thermistor portion 7, so as to more eliminate the influence of the distance between the external electrodes 5, 5 and other factors on the resistance of the chip thermistor 1.

In the chip thermistor 1, the external electrodes 5, 5 are formed to cover respective end faces 3*a*, 3*b* in the longitudinal direction of the element body 3. For this reason, connection strength between the external electrodes 5, 5 and the composite portions 9, 9 which constitute a part of the element body 3 is made firm.

In the chip thermistor 1, the external electrodes 5, 5 are formed to oppose to each other on the side faces 3*c* to 3*f* which extend along the longitudinal direction of the element body 3. For this reason, connection strength between the external electrodes 5, 5 and the composite portions 9, 9 which constitute a part of the element body 3 is made further firm. Since the external electrodes 5, 5 are formed on the side face 3*d* (a mounting surface) of the element body 3, it is feasible to easily mount the chip thermistor 1 on a surface of a substrate or the like.

In the chip thermistor 1, the external electrodes 5, 5 are formed not to cover the thermistor portion 7 which constitutes a part of the element body 3. In the case, it is feasible to reduce the influence to the resistance if the thickness of the thermistor portion 7 is thin.

Second Embodiment

Figure 7:
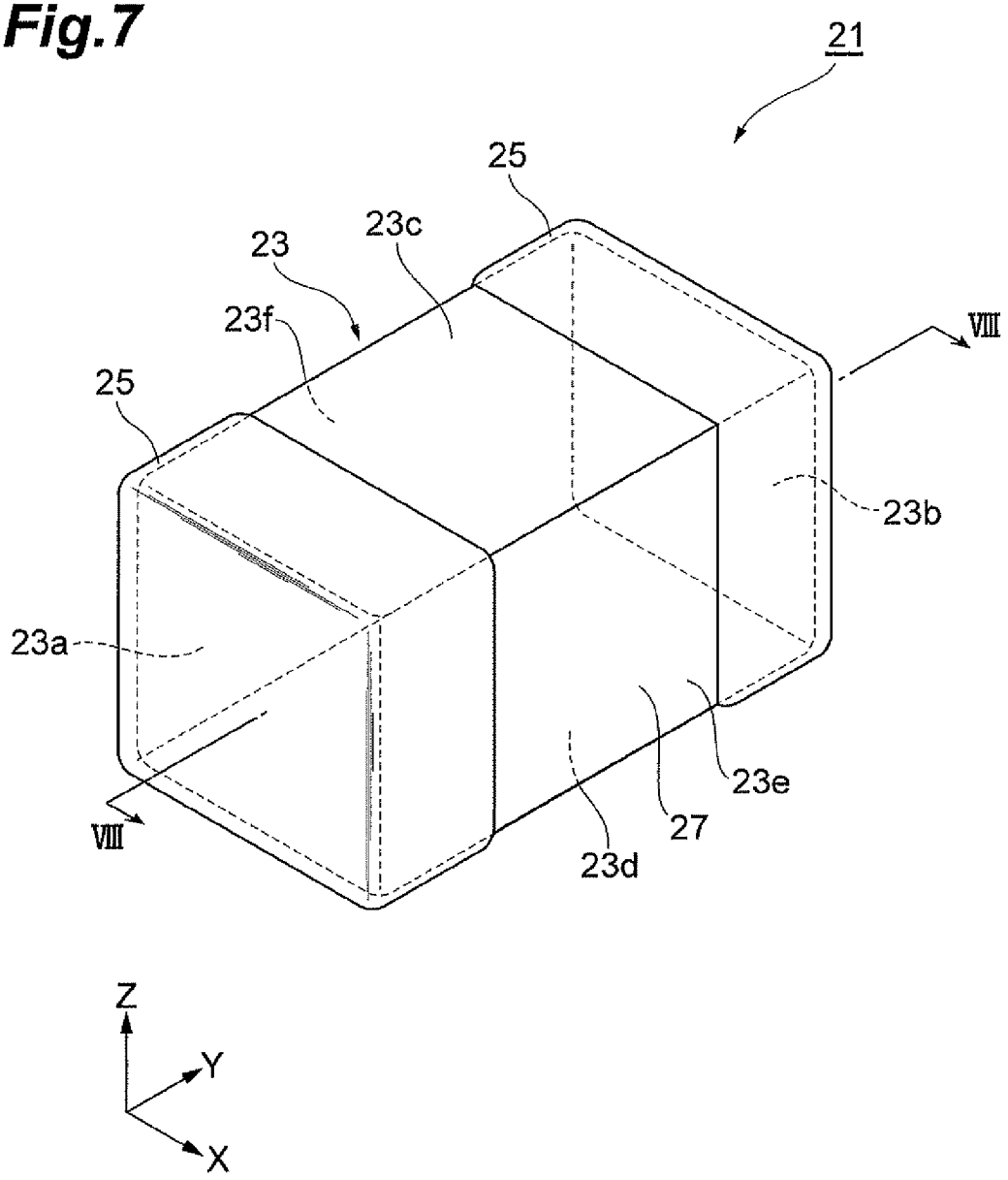
FIG. 7 is a perspective view showing a chip thermistor according to a second embodiment

Next, a chip thermistor 21 of the second embodiment will be described. The chip thermistor 21 is an NTC thermistor as well as the first embodiment and, as shown in FIG. 7, comprises an element body 23 of a substantially rectangular parallelepiped shape, and a pair of external electrodes 25, 25 formed at both ends in a longitudinal direction of the element body 23. The chip thermistor 21 is, for example, a thermistor of an extremely small size having the length of 0.4 mm in the Y-direction in the drawing, the height of 0.2 mm in the Z-direction, and the width of 0.2 mm in the X-direction (which is so called "0402"). The second embodiments will be explained mainly with differences from the first embodiment in the following.

Figure 8:
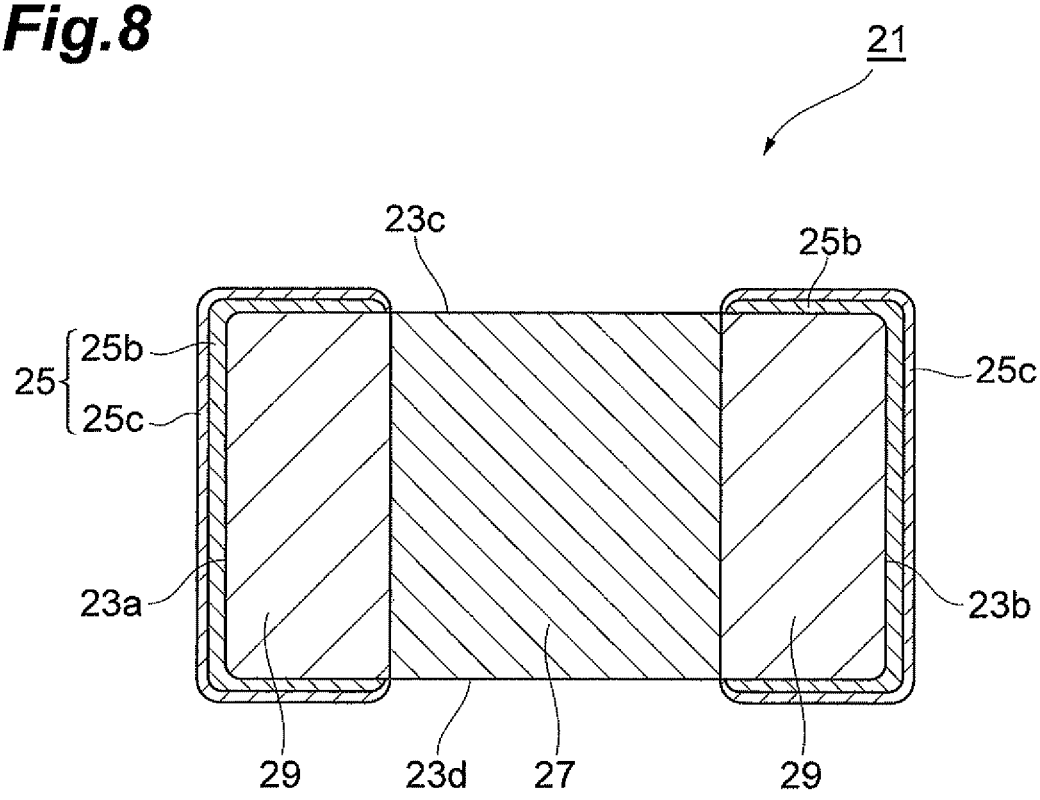
FIG. 8 is a cross-sectional view along the line VIII-VIII in FIG. 7

The element body 23 is configured to include a thermistor portion 27 and a pair of composite portions 29, as showed in FIG. 8. The element body 23 has square end faces 23*a*, 23*b* opposed to each other, and four side faces 23*c* to 23*f* perpendicular to the end faces 23*a*, 23*b* as outer surfaces.

The thermistor portion 27, as shown in FIGS. 7 and 8, is a portion of a rectangular parallelepiped shape located in a nearly central region of the element body 23 and is composed of a thermistor element having a negative characteristic. The thermistor portion 27, as same as the first embodiment, is formed as a portion in a layered structure in which a plurality of thermistor layers 7*a* with a predetermined B value are laminated in the Y-direction in the drawing (in a direction in which the composite portions 29 are opposed to each other). In the present embodiment, the plurality of thermistor layers 7*a* are laminated so that the thickness of the thermistor portion 27 is, for example, 200 μm; therefore, the thickness of the thermistor portion 27 is 0.5 times (or 50% of) 400 μm being the longitudinal (Y-directional) length of the element body 23.

The composite portions 29, as shown in FIG. 8, are portions of a substantially rectangular parallelepiped shape located in regions shifted from the central region of the element body 23 to the both end sides, and are arranged on both sides of the thermistor portion 27 so as to sandwich in the thermistor potion 27 between them. The composite portions 29, as same as the first embodiment, are formed as portions in a layered structure in which a plurality of composite layers 9*a* comprised of a composite material including Ag—Pd (metal) and respective metal oxides of Mn, Ni and Co, are laminated in the Y-direction in the drawing. Since each of the composite portions 29 opposed to each other with the thermistor portion 27 in between is formed of a laminate of the same number of composite layers 9*a*, they have the same size.

The pair of external electrodes 25, 25 are formed so as to cover substantially all of outer surfaces of the composite portions 29, 29, which includes the respective end faces 23*a*, 23*b* of the element body 23. The external electrode 25 is formed by directly plating the composite portion 29 which constitutes a part of the element body 23 and includes: a second electrode layer 25*b* directly formed on the composite portion 29 and containing Ni as a major ingredient; and a third electrode layer 25*c* formed so as to cover the second electrode layer 25*b* and containing Sn as a major ingredient. In this embodiment, the external electrode 25 does not include the first electrode layer formed from an electroconductive paste, unlike the first embodiment. Thickness in the longitudinal direction (Y-direction) of the external electrode 25, which is formed so as to approximately cover the entire surface of the composite portion 29, is 100 μm, yielding a thickness of an extent that enables surface installation of the substrate or the like (enables adherence to the substrate land or the like with solder).

The chip thermistor 21 provided with such a configuration can be produced using approximately the same production method as the first embodiment. However, the second embodiment differs from the first embodiment in that, since the insulating layer 11 is not formed, step S06 shown in FIG. 5 is not performed. Furthermore, in step 07 for forming the external electrodes, Ni forming the second electrode layer 25*b* is directly plated on the composite portion 29, and Sn forming the third electrode layer 25*c* is plated thereon, without forming the first electrode layer. This enables the chip thermistor 21 provided with a double-layered structure of the external electrodes 25, 25 to be obtained.

As mentioned above, the chip thermistor 21 according to the present embodiment is configured, as shown in FIG. 8, such that the pair of composite portions 29, 29 are disposed on either side of the thermistor portion 27, which is sandwiched therebetween, and the external electrodes 25, 25 are connected to the pair of composite portions 29, 29. That is, the pair of composite portions 29, 29 are used as bulk electrodes. As such, the resistance in the thermistor portion 27 may be considered as the main one for adjusting the resistance value of the chip thermistor 21, enabling the resistance value to be easily adjusted, and enabling a chip thermistor provided with suppressing variations in resistance values to be obtained.

The working effect of the chip thermistor 21 mentioned above will now be described on the basis of a comparative experiment with conventional chip thermistors. The comparative experiment was performed by comparing CV values of the chip thermistor 21, and the CV values of the conventional type of chip thermistor, wherein a resistance value is yielded by a portion comprising a typical capacitor structure and an overlapping pair of internal electrodes (internal electrode layered structure type), in each of four different chip configuration size types.

Chip configurations used in the comparative example:

1) 1608 (length: 1.6 mm; height and width: 0.8 mm)
2) 1005 (length: 1.0 mm; height and width: 0.5 mm)
3) 0603 (length: 0.6 mm; height and width: 0.3 mm)
4) 0402 (length: 0.4 mm; height and width: 0.2 mm)

The CV values used in this comparative example are indices showing the extent of variations in element resistance values at 25° C., and are shown in formula (1) below. In the present comparative example, the number N of each sample was 30.

$$CV\text{ value}=(\text{standard deviation/mean resistance value})\times 100\% \quad (1)$$

The results of the comparative experiment mentioned above are shown in Table 1 below.

TABLE 1

| | 1 | 2 | 3 | 4 |
|---|---|---|---|---|
| Chip Configuration | 1608 | 1005 | 0603 | 0402 |
| Measurements (mm) | 1.6 * 0.8 * 0.8 | 1.0 * 0.5 * 0.5 | 0.6 * 0.3 * 0.3 | 0.4 * 0.2 * 0.2 |
| Internal electrode layered structure type (CV value) | 0.8 | 1.2 | 3.8 | 5.6 |
| Chip thermistor 21 (CV value) | 0.5 | 0.7 | 1.4 | 1.9 |

As shown in Table 1, the chip thermistor 21 made it possible to lower the CV value over the conventional chip component in all four chip configuration types. That is, the chip thermistor 21 enables variation in resistance value to be suppressed. Specifically, in the chip thermistor 21, there was a tendency for the CV value to be significantly reduced compared to the conventional component for the smaller chip configurations (e.g. 0603 and 0402). The reason for this is considered to be that, in a component with an internal electrode layered structure such as the conventional component, smaller chip configurations cause printing variations upon printing the internal electrodes and layering variations upon layering occur, and increases the influence on the resistance value, whereas the chip thermistor 21 shown in the second embodiment enables the influence of such variations to be reduced.

Furthermore, in addition to the working effect mentioned above, the chip thermistor 21 also enables the resistance to be lowered and the range of resistance value adjustment to be widened. Moreover, the heat in the chip thermistor 21 can be easily dissipated via the composite portions 29, 29, enabling the chip thermistor 21 with excellent heat dissipation to be obtained. Specifically, thermistors are originally characterized in that their resistance values change due to heat, and thus the excellent heat dissipation of the chip thermistor 21 increases its thermal responsiveness, allowing more accurate detection.

Furthermore, in the chip thermistor 21, the external electrodes 25, 25 are formed by directly plating onto the composite portions 29, 29. As such, processes such as printing and firing the first electrode layer formed from an electroconductive paste or the like become unnecessary, and the thermal influence of firing on the chip thermistor can be reduced. Furthermore, in this way, since the first electrode layer is no longer required, a further reduction in the size of the chip thermistor becomes possible. Also, the plating is coated along the shape of the element 23, and thus the flatness of the exterior of the chip thermistor 21 can be enhanced, thereby preventing the chip thermistor 21 from tumbling in a housing for a series of electronic components, and making it possible to reduce faults in installing the chip thermistor 21 onto a substrate or the like.

In the chip thermistor 21, furthermore, the external electrodes 25, 25 are configured so as to cover substantially all of the external surfaces of the composite portions 29, 29, and thus the thicknesses of the composite portions 29, 29 directly correspond to the widths of the external electrodes 25, 25, and variations of the width measurements in both external electrodes 25, 25 can be suppressed. As a result of this, it is possible to reduce phenomena such as tombstoning upon installation, which is caused by differences in the melting time of solder due to variations in the width measurements of the external electrodes 25, 25. In the present embodiment, since external electrodes 25, 25 are formed so as to cover substantially all of the external surfaces of the composite portions 29, 29, in some cases the external electrodes 25, 25 may cover part of the surface of thermistor portion 27. However, even in such cases, the plating of which the external electrodes 25, 25 are composed does not completely adhere to the thermistor portion 27, and thus barely influences the resistance value of the chip thermistor 21.

Figure 9:
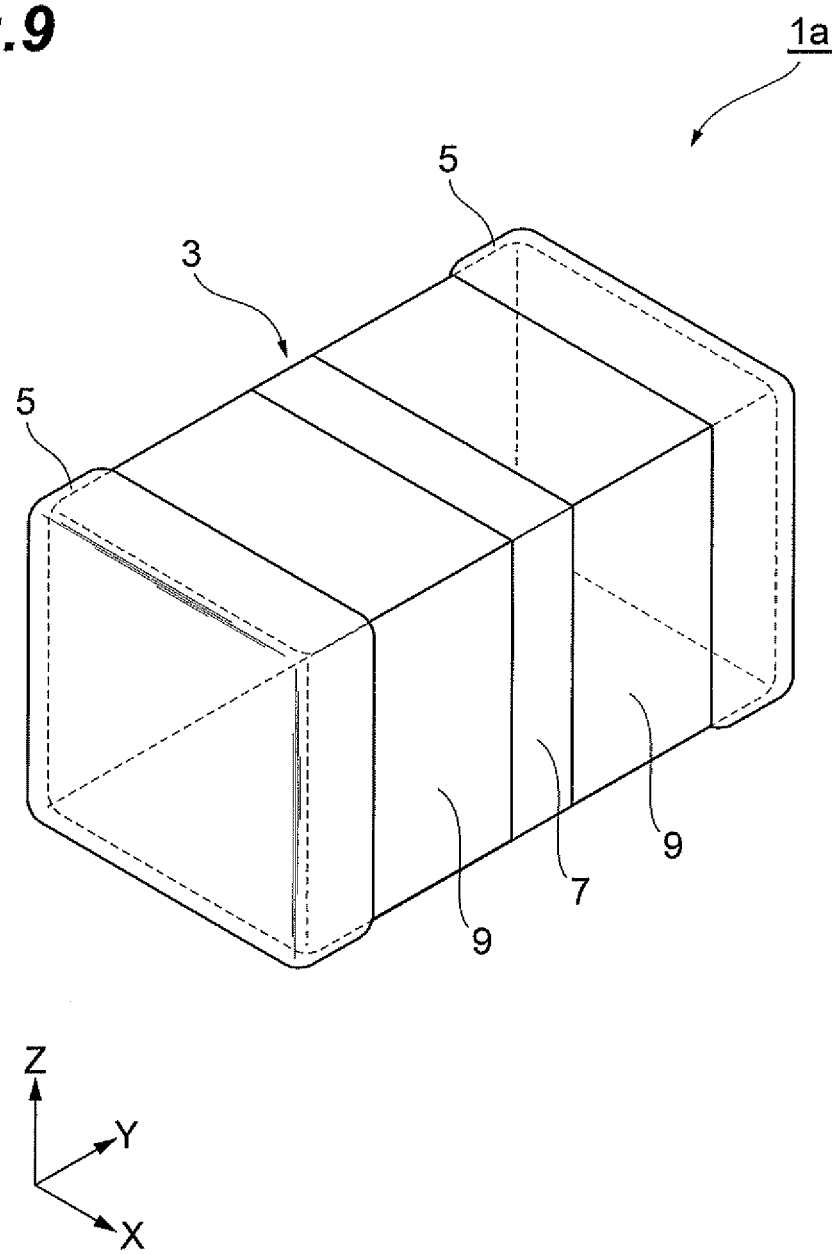
FIG. 9 is a perspective view showing a modification example of the chip thermistor.

The embodiments of the present invention were described above in detail, but it should be noted that the present invention is not limited solely to the above embodiments and can be modified in many ways. For example, the first embodiment showed the case where the thickness of the thermistor portion 7 was 100 μm and the second embodiment showed the case where the thickness of the thermistor portion 27 was 200 μm, but, in order to further decrease the resistance of the chip thermistor, as shown in FIG. 9, the thickness of the thermistor portion 7 may be set to 40 μm to obtain the chip thermistor 1*a* in which the thickness of the thermistor portion 7 is 0.1 times (or 10% of) 400 μm being the longitudinal (Y-directional) length of the element body 3. In terms of reduction in resistance of the chip thermistor, the thickness of the thermistor portion 7 is more preferably not more than 0.1 times the longitudinal length of the element body 3, and the thermistor portion 7 in such thickness can be readily formed by employing the aforementioned configuration and manufacturing method of laminating the thermistor layers 7*a*. It is, however, noted that the chip thermistor according to the present invention is not limited only to the manufacture by the foregoing manufacturing method and it is a matter of course that the chip thermistor may be manufactured by any other manufacturing method.

Figure 10:
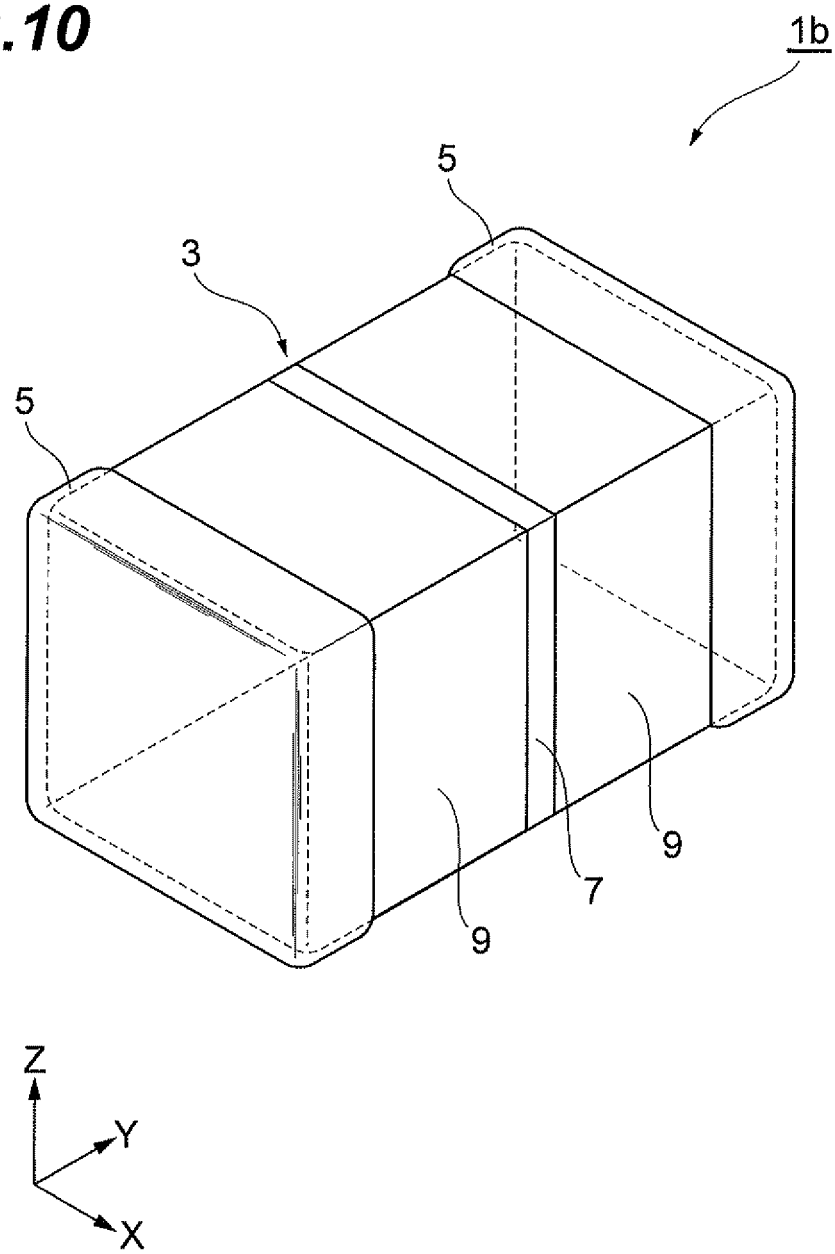
FIG. 10 is a perspective view showing another modification example of the chip thermistor.

In order to further decrease the resistance of the chip thermistor, as shown in FIG. 10, the thickness of the thermistor portion 7 may be set to 10 μm to obtain the chip thermistor 1*b* in which the thickness of the thermistor portion 7 is 0.025 times (or 2.5% of) 400 μm being the longitudinal (Y-directional) length of the element body 3. On the other hand, the thicknesses of the thermistor portions 7, 27 may be increased to be 300 μm or 320 μm and the thicknesses of the thermistors 7, 27 may be 0.75 times (or 75%) to 0.8 times (80%) 400 μm being the longitudinal length of the element bodies 3, 23. In this manner, the thickness of the thermistor portion 7 may be set to any length in the range of 0.025 times to 0.8 times the longitudinal length of the element body 3, but the thicknesses of the thermistor potions 7, 27 does not always have to be limited to this range. The thicknesses can be determined by suitably selecting and applying any length, for example, between 0.01 times and 0.8 times the longitudinal length of the element bodies 3, 23.

The above embodiments showed the example in which the chip thermistor 1 was the NTC thermistor, but the present invention is not limited only to it; it is a matter of course that the present invention may also be applied to other chip thermistors such as a PTC (Positive Temperature Coefficient) thermistor.

| Reference Signs List | |
|---|---|
| 1, 1a, 1b, 21 | Chip thermistor, |
| 3, 23 | element body, |
| 5, 25 | external electrode, |
| 7, 27 | thermistor portion, |
| 7a | thermistor layer, |
| 9, 29 | composite portion, |
| 9a | composite layer, |
| 9b | electrical conduction path, |
| 11 | insulating layer |

The invention claimed is:

1. A chip thermistor comprising:

a thermistor portion comprised of a ceramic material containing a metal oxide as a major ingredient;

a pair of composite portions comprised of a composite material including a metal and a metal oxide and arranged on both sides of the thermistor portion so as to sandwich in the thermistor portion between the composite portions; and external electrodes arranged at both ends in a longitudinal direction of an substantially rectangular parallelepiped shaped element body which includes the thermistor portion and the pair of composite portions, the external electrodes are connected to the pair of composite portions respectively.

2. The chip thermistor according to claim 1, wherein each of the external electrodes is configured to cover respective end faces in the longitudinal direction of the element body.

3. The chip thermistor according to claim 1, wherein each of the external electrodes is configured to oppose to each other on at least one side face which extends along the longitudinal direction of the element body.

4. The chip thermistor according to claim 1, wherein the thermistor portion is configured in a layered structure such that a direction in which the pair of composite portions are opposed to each other is a laminated direction.

5. The chip thermistor according to claim 1, wherein each of the pair of composite portions is configured in a layered structure such that a direction in which the pair of composite portions are opposed to each other is a laminated direction.

6. The chip thermistor according to claim 1, wherein the thermistor portion is substantially totally connected to the pair of composite portions, on both sides thereof.

7. The chip thermistor according to claim 1, wherein the thermistor portion is composed of a thermistor element having a negative characteristic, and wherein a thickness of the thermistor portion in a direction in which the pair of composite portions are opposed to each other is any length in the range of 0.01 times to 0.8 times a longitudinal length of the element body.

8. The chip thermistor according to claim 1, wherein the composite material is a material in which the metal is dispersed in the metal oxide or in which the metal oxide is dispersed in the metal.

9. The chip thermistor according to claim 1, wherein in each of the pair of composite portions, the metal in the composite material forms an electrical conduction path between the external electrode and the thermistor portion.

10. The chip thermistor according to claim 1, wherein the external electrodes are formed by electroplating.

11. The chip thermistor according to claim 1, wherein an insulating layer is formed at least over a region across the thermistor portion out of an exterior surface of the element body.

12. The chip thermistor according to claim 1, wherein the external electrodes are formed by directly plating the composite portions which constitutes a part of the element body.

13. The chip thermistor according to claim 1, wherein the external electrodes are configured to cover substantially all of outer surfaces of the composite portions which constitute a part of the element body.

14. The chip thermistor according to claim 1, wherein the external electrodes are configured not to cover the thermistor portion which constitutes a part of the element body.

15. A method for manufacturing a chip thermistor, comprising:

preparing thermistor layers comprised of a ceramic material containing a metal oxide as a major ingredient;

preparing composite layers comprised of a composite material including a metal and a metal oxide;

laminating the thermistor layers and the composite layers to obtain a multilayer body such that a predetermined number of said thermistor layers are sandwiched in between the composite layers;

cutting the multilayer body to obtain a plurality of element bodies; and forming external electrodes at both ends of the element bodies in such a manner that a laminated direction of the thermistor layers and the composite layers is a direction in which the external electrodes are opposed to each other.

16. The chip thermistor according to claim 1, wherein a thickness of the thermistor portion is controlled based on a number of identical thermistor layers laminated together.

17. The chip thermistor according to claim 1, wherein a resistance of the chip thermistor is controlled based on a number of identical thermistor layers laminated together.

18. The method for manufacturing a chip thermistor according to claim 15, wherein a thickness of the thermistor layers is controlled based on a number of identical thermistor layers laminated together.

19. The method for manufacturing a chip thermistor according to claim 15, wherein a resistance of the chip thermistor is controlled based on a number of identical thermistor layers laminated together.

* * * * *